US008021076B2

(12) United States Patent
Hoppe

(10) Patent No.: US 8,021,076 B2
(45) Date of Patent: Sep. 20, 2011

(54) RUNWAY FOR AIRCRAFT AND ROADWAY FOR VEHICLES AND METHOD OF RENEWING A RUNWAY OR ROADWAY

(75) Inventor: Friedemann Hoppe, Klein Kussewitz (DE)

(73) Assignee: hkc Ilackmann + Kollath Ingenieur-Consult GmbH, Rostock (DE)

( * ) Notice: Subject to any disclaimer, the term of this patent is extended or adjusted under 35 U.S.C. 154(b) by 0 days.

(21) Appl. No.: 12/379,811

(22) Filed: Mar. 2, 2009

(65) Prior Publication Data

US 2009/0279952 A1 Nov. 12, 2009

Related U.S. Application Data

(63) Continuation of application No. PCT/DE2007/001530, filed on Aug. 28, 2007.

(30) Foreign Application Priority Data

Aug. 31, 2006 (DE) ..... 10 2006 040 896

(51) Int. Cl.
*E01C 23/06* (2006.01)
*E01C 11/00* (2006.01)

(52) U.S. Cl. ..... 404/82; 404/17; 404/72; 404/75

(58) Field of Classification Search ..... 404/17, 404/27, 31, 72, 75, 82
See application file for complete search history.

(56) References Cited

U.S. PATENT DOCUMENTS 2,062,615 A * 12/1936 Scripture, Jr. ..... 404/27
3,858,999 A * 1/1975 Kadono et al. ..... 404/27
3,870,422 A * 3/1975 Medico, Jr. ..... 404/31
3,970,404 A * 7/1976 Benedetti ..... 404/77
4,226,552 A * 10/1980 Moench ..... 404/92
4,606,963 A * 8/1986 Farrell ..... 428/150
4,708,516 A * 11/1987 Miller ..... 404/31

(Continued)

FOREIGN PATENT DOCUMENTS

DE 2 202 531 8/1973

(Continued)

OTHER PUBLICATIONS

Holl, A., "Stichwort: Straβenbau (bit)", Bauverlag GmbH, Wiesbaden, Berlin 1977, pp. 10 to 19.

(Continued)

*Primary Examiner* — Raymond Addie
(74) *Attorney, Agent, or Firm* — Walter Ottesen

(57) ABSTRACT

The cover layer is applied as an asphalt cover layer (5, 5', 5") to avoid significant restrictions of the running traffic and for shortening the construction time. Also, this asphalt cover layer is arranged above the upper face (OK) of the runway or roadway in need of renewal and an asphalt base coarse layer (4, 4', 4", 4'", 4"", 4'"") is disposed between the base layer (2, 2') and the asphalt cover layer (5, 5', 5"). A method subdivides the roadway or runway in the direction of travel into a primary lane (7) and at least one secondary lane (8, 9). First, the work subzones (10) to (14) of the primary lane (7) are processed and then the work effort is transferred to subzones (15) to (20) of the secondary lanes (8, 9) for processing. At least the frost-protective layer (1) remains in the earth and at least an asphalt base layer (4, 4', 4", 4'", 4"", 4'"") and an asphalt cover layer (5, 5', 5") are applied thereon. The asphalt base layer (4, 4') is applied to the level of the upper face (OK) for the old way and the asphalt cover layer (5, 5', 5") is applied above the level of the upper face (OK) of the old way.

11 Claims, 2 Drawing Sheets

U.S. PATENT DOCUMENTS

| | | | | | |
|---|---|---|---|---|---|
| 5,026,205 | A | * | 6/1991 | Gorski et al. | 404/72 |
| 5,026,609 | A | * | 6/1991 | Jacob et al. | 428/489 |
| 5,249,883 | A | * | 10/1993 | Watson et al. | 404/31 |
| 5,419,653 | A | * | 5/1995 | Hollon et al. | 404/17 |
| 5,735,634 | A | * | 4/1998 | Ulrich et al. | 404/102 |
| 5,762,446 | A | * | 6/1998 | Manatt et al. | 404/75 |
| 5,895,173 | A | * | 4/1999 | O'Brien et al. | 404/108 |
| 5,921,706 | A | * | 7/1999 | Manatt et al. | 404/72 |
| 6,158,920 | A | * | 12/2000 | Malot | 404/27 |
| 6,588,974 | B2 | | 7/2003 | Hildebrand et al. | |
| 7,150,581 | B2 | * | 12/2006 | Lowe | 404/75 |
| 7,448,825 | B2 | * | 11/2008 | Kasahara et al. | 404/80 |
| 7,621,693 | B2 | * | 11/2009 | McDonald | 404/17 |
| 2001/0022919 | A1 | * | 9/2001 | Bruns et al. | 404/91 |
| 2005/0135879 | A1 | * | 6/2005 | Grubba et al. | 404/75 |
| 2006/0045621 | A1 | * | 3/2006 | Potts et al. | 404/91 |
| 2009/0097918 | A1 | * | 4/2009 | Larson et al. | 404/75 |

FOREIGN PATENT DOCUMENTS

| | | | |
|---|---|---|---|
| DE | 36 11 199 | | 10/1987 |
| DE | 42 37 512 | | 5/1994 |
| DE | 200 15 289 | U | 11/2000 |
| DE | 20 2005 009 656 | U | 9/2005 |
| EP | 0 158 560 | | 10/1985 |
| EP | 0 469 222 | | 2/1992 |
| EP | 0 728 871 | | 8/1996 |
| EP | 0 730 693 | | 9/1996 |
| GB | 2 227 268 | | 7/1990 |
| WO | WO 99/11737 | * | 3/1999 |

OTHER PUBLICATIONS

Blessmann, W. et al, "Überbauung einer Betondecke mit standfestem Asphalt für eine zeitlich begrenzte Nutzung", Bitumen Feb. 1994, pp. 61 to 65.

Tappert, A., "Erneuerung von abgängigen Betonfahrbahndecken durch Asphaltschichten", Bitumen Mar. 1991, pp. 114 to 119.

"Medienmitteilung: Autobahn A2 zwischen Erstfeld und Amsteg wird komplett erneuert", Uri Baut, Kanton Uri, XP-002486276, No. 1/2005, pp. 1 to 6.

"Sanierung der Start- und Landebahn Süd am Flughafen Frankfurt", tis Jul.-Aug. 2006, XP-002486277, pp. 36 and 37.

Straube, E. et al, "Straβenbau und Straβenerhaltung: Ein Handbuch für Studium und Praxis", Erich Schmidt Verlag, Berlin 2004, XP-007904914, pp. 240 to 247.

* cited by examiner

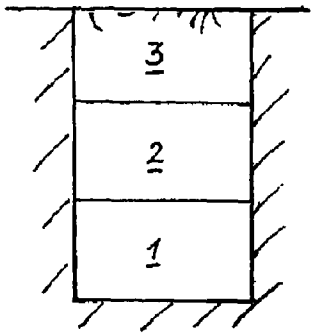
Fig. 1
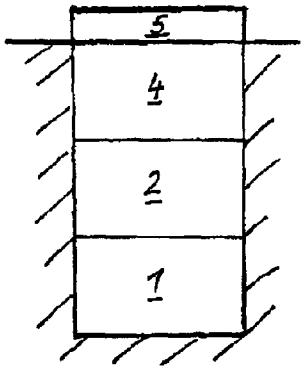
Fig. 2
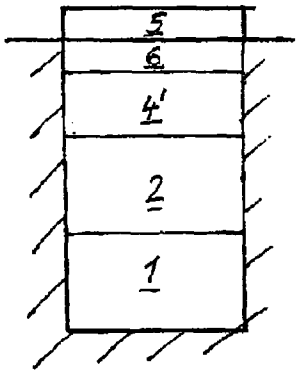
Fig. 3
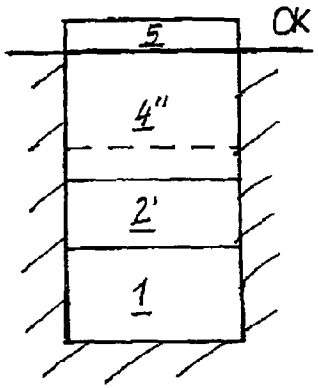
Fig. 4
Fig. 5
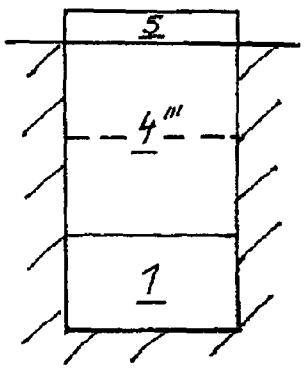
Fig. 6
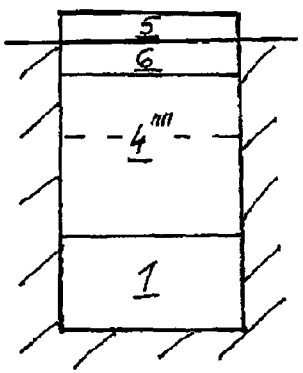
Fig. 7
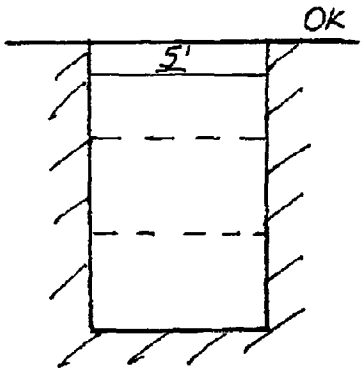
Fig. 8

RUNWAY FOR AIRCRAFT AND ROADWAY FOR VEHICLES AND METHOD OF RENEWING A RUNWAY OR ROADWAY

CROSS REFERENCE TO RELATED APPLICATIONS

This application is a continuation application of international patent application PCT/DE 2007/001530, filed Aug. 28, 2007, designating the United States and claiming priority from German application 10 2006 040 896.9, filed Aug. 31, 2006, and the entire content of both applications is incorporated herein by reference.

FIELD OF THE INVENTION

The invention relates to a way including a roadway and runway and a corresponding method for renewing a way with a cover layer preferably of concrete.

BACKGROUND OF THE INVENTION

Such ways are especially for take-off and landing runways for aircraft but also roadways for road traffic. The roadways for street traffic are mostly expressways. The ways and corresponding methods are used for renewing existing ways.

Conventional ways have, generally, a conventional construction which comprises a cover layer, a base layer and a frost-protective layer. The cover layer forms the upper end of the traffic surfaces. The cover surfaces are, as a rule, configured to be bonded and comprise concrete or asphalt and, if required, also comprise a pavement covering.

The base layer or base course is essentially responsible for the load bearing capacity of the traffic surface and preferably comprises pebble stones, crushed stone, recycled material or asphalt. Especially under concrete cover layers, base layers are often configured so as to be hydraulically bonded (HGT).

The frost-protective layer serves to ensure a frost secure thickness of the upper structure of the traffic area. A material used here is preferably pebble stones, crushed stone or recycled material.

Further conventional constructions and modifications are set forth, for example, in the RStO 01 (Richtlinien für die Standardisierung des Oberbaus von Verkehrsflächen-derzeitiger Stand 2001) or the "Arbeitshilfen Flugbetriebsflächen" applicable for the German army.

Runways and roadways are subjected to wear over a long load time frame as a consequence of traffic and weather influences. The wear becomes manifest by distressed locations, unevenness and fissures in the upper cover layer. To renew the worn ways, considerable efforts are required and especially the renewing of concrete ways is problematic.

Various methods are known for renewing concrete ways. In a first renewing or renovating method, an additional bituminous cover or topping is applied. For this purpose, the upper lying cover layer is first destressed by crushing the concrete to prevent the later formation of reflection fissures in the bituminous cover. Thereafter, a bituminous cover is applied above the previous way upper surface. Reinforcing fabrics for taking up the stresses occurring in the concrete are rolled in as a supplement in some cases.

Notwithstanding these measures, the penetration of reflection fissures into the asphalt cover can rarely be avoided which, from experience, can be detected already after a few years. This is primarily attributable to concrete pieces which result in different sizes and shapes during the crushing of the concrete cover and which are hardly definable with respect to their physical characteristics. This leads to qualitative and measurable risks.

The high heat absorption of the applied asphalt cover furthermore causes a heating up of the unstressed concrete cover whereby the risk of fissure formation is further increased. This finally leads to a further renewing requirement and puts into question the durability of concrete surface renewal with bituminous covers. Among engineers in the field of road building and runway building, there is therefore considerable reservation with respect to this renewing method notwithstanding the very short construction times.

In practice, replacement new construction is favored as a renewing method and not the least because of the problems of construction cover layers.

Here, the entire configuration of the roadway including the frost layer, the base layer and the concrete cover layer are replaced by a completely new roadway construction. This replacement new construction satisfies all technical requirements but also constitutes, by comparison, the most cost intensive and time intensive renewing method. Furthermore, the tie-up time limit of the concrete, which has to be considered, causes further traffic restrictions which are often not acceptable.

In the journal "Tiefbau-Ingenieurbau-Strassenbau", 7-8/2006, pages 36 and 37, a new renewing method is introduced which was first applied at the airport in Frankfurt/Main, Germany according to this information. In principle, this method is seen as a replacement new construction. What is significant is that each subzone of 15 m length and 60 m lane width is exchanged in nighttime windows and therefore an unrestricted flight operation during the day is made possible. The concrete cover including the base layer and frost-protective layer disposed therebeneath in a total thickness of 60 cm is removed and is replaced by a fully bonded upper structure of asphalt. This upper structure of asphalt comprises first and second base layers with each base layer having a thickness of 24 cm as well as a binder layer having a thickness of 12 cm.

The cover joint is produced after completion of the binder layer at the end of each work time window in order to make traffic use possible. Because of the thickness of the asphalt packet of 60 cm, the surface temperature is still at approximately 100° C. after placement and must be cooled down to approximately 85° C., possibly with the use of water trucks or the like, to ensure flight operations.

After completing several mutually connected subzones of the runway as described, the top-lying asphalt binder layer of this total thickness is milled down by approximately 4 cm. Directly thereafter, a continuous asphalt cover layer is built-in in the milled-off region which, in turn, defines the final cover top.

The advantage of this renewing method is that the way can be further used during the building time without significant limitations. This renewing method has, however, considerable disadvantages.

Accordingly, the material use of asphalt over the entire top structure of the way is hardly economically justifiable as a rule. Because of compaction, the installation of the individual layers must take place in sublayers of up to 15 cm thickness. This increases the work complexity and limits the area capacity to the comparatively small work subzones of 15 m×60 m.

A further disadvantage is introduced in that individual work subzones, which are to be worked upon, extend over the entire width of the way and for a take-off runway and landing runway can amount to between 30 and 60 m. This is a disadvantage with respect to the expansion of the individual work subzones in the longitudinal direction of the way because the surface capacity is limited to approximately 900 $m^2$ because of time reasons and logistic reasons.

This is especially disadvantageous in the renewing of roadways for street traffic because a complete blocking of the road section to be built and the detouring of the flowing street traffic to other roads is required. This is no longer acceptable for the density of street traffic of today.

Furthermore, because of the shortness of the work sections of 15 m, a relatively high number of work joints results which can become noticeable as jolts for the running traffic during the building phase.

This is especially the case when a transverse profile improvement is undertaken already in the course of the provisional cover closing. This problem can only be solved with the large area cover installation. The relatively high number of work joints can also lead to future problems which applies especially for regions used the most.

SUMMARY OF THE INVENTION

It is an object of the invention to provide a roadway or runway and a method for renewing a runway or roadway which require only a reduced work effort while providing a high quality of the way and which lead to a reduction of the processing time. Furthermore, the new way and the new method make possible a renewing of the way without significantly limiting the running traffic.

The roadway of the invention is for motor vehicles and a runway for aircraft. The way has an upper face OK before a renewal of the way is carried out. The way has been renewed and now includes: a frost-protective layer; a base course disposed atop the frost-protective layer; the frost-protective layer and the base course having been present before and after the way was renewed; an asphalt cover layer disposed above the upper face OK; an asphalt base layer interposed between the base course and the asphalt cover layer; and, the asphalt cover layer and the asphalt base layer being present and part of the way after the renewal thereof.

The method of the invention is for renewing a roadway for motor vehicles and a runway for aircraft during operational use of the way. The method includes the steps of: subdividing the way, in the direction of travel thereon, into a primary lane and at least one secondary lane adjacent the primary lane; subdividing the primary lane into a first plurality of subzones and subdividing the secondary lane into a second plurality of subzones; and, first sequentially working the subzones of the primary lane during an out-of-service time period of the primary lane by demolishing, removing and replacing with a new structure in the primary lane and then sequentially working the subzones of the secondary lane during an out-of-service time period of the secondary lane by demolishing, removing and replacing with a new structure in the secondary lane.

The method of the invention is for renewing a roadway for motor vehicles and a runway for aircraft. The way has an upper face (OK) before the renewal thereof and includes a frost-protective layer, a base coarse layer and a cover layer. The method includes the steps of: demolishing and renewing one or more of the layer(s) no longer needed while leaving at least the frost-protective layer in the earth; applying at least one asphalt base layer onto the frost-protective layer and bringing the asphalt base layer up to the level of the upper face (OK); and, applying an asphalt cover layer onto the asphalt base layer to a level above the upper face (OK).

The new renewed way and the two new renewing methods eliminate the above-mentioned disadvantages of the state of the art.

The special advantage of the new way is that the existing way surface continues to be used again to the greatest extent possible. This saves building time, material, cost and energy whenever the new way is used as a substitute for a worn way.

This new way and the two renewing methods are especially advantageous for renewing worn concrete ways because they result in very short processing times and ways must be blocked only for a short time to public traffic. This advantage applies especially to take-off runways and landing runways for aircraft which have an intensely reflecting center strip which is subject to intense load and therefore is the first to wear.

A significant advantage of the new way and the two new renewing methods comprises that the new way can be connected to an existing way with an unbonded base layer without an outflow occurring and therefore without the formation of a hollow space forming under the surface layer of the existing way when demolition and excavation work takes place. This is so because, for a new way, excavation work to only a limited depth is required and therefore an outflow of the unbonded base layer of the existing way is not at all possible. A subsequent back cut of the surface layer of the existing way is therefore avoided which considerably reduces the renewing costs and the restrictions to traffic.

BRIEF DESCRIPTION OF THE DRAWINGS

The invention will now be described with reference to the drawings wherein:

FIG. 1 shows, in section, the structure of a runway or roadway requiring renewal;

FIG. 2 shows, in section, the structure of a renewed way according to a first embodiment;

FIG. 3 shows, in section, the structure of a renewed way according to a second embodiment;

FIG. 4 shows, in section, the structure of a renewed way according to a third embodiment;

FIG. 5 shows, in section, the structure of a renewed way according to a fourth embodiment;

FIG. 6 shows, in section, the structure of a renewed way according to a fifth embodiment;

FIG. 7 shows, in section, the structure of a renewed way according to a sixth embodiment;

FIG. 8 shows, in section, the structure of a renewed way according to a seventh embodiment;

DESCRIPTION OF THE PREFERRED EMBODIMENTS OF THE INVENTION

Figures 9, 10, 11, 12, 13:
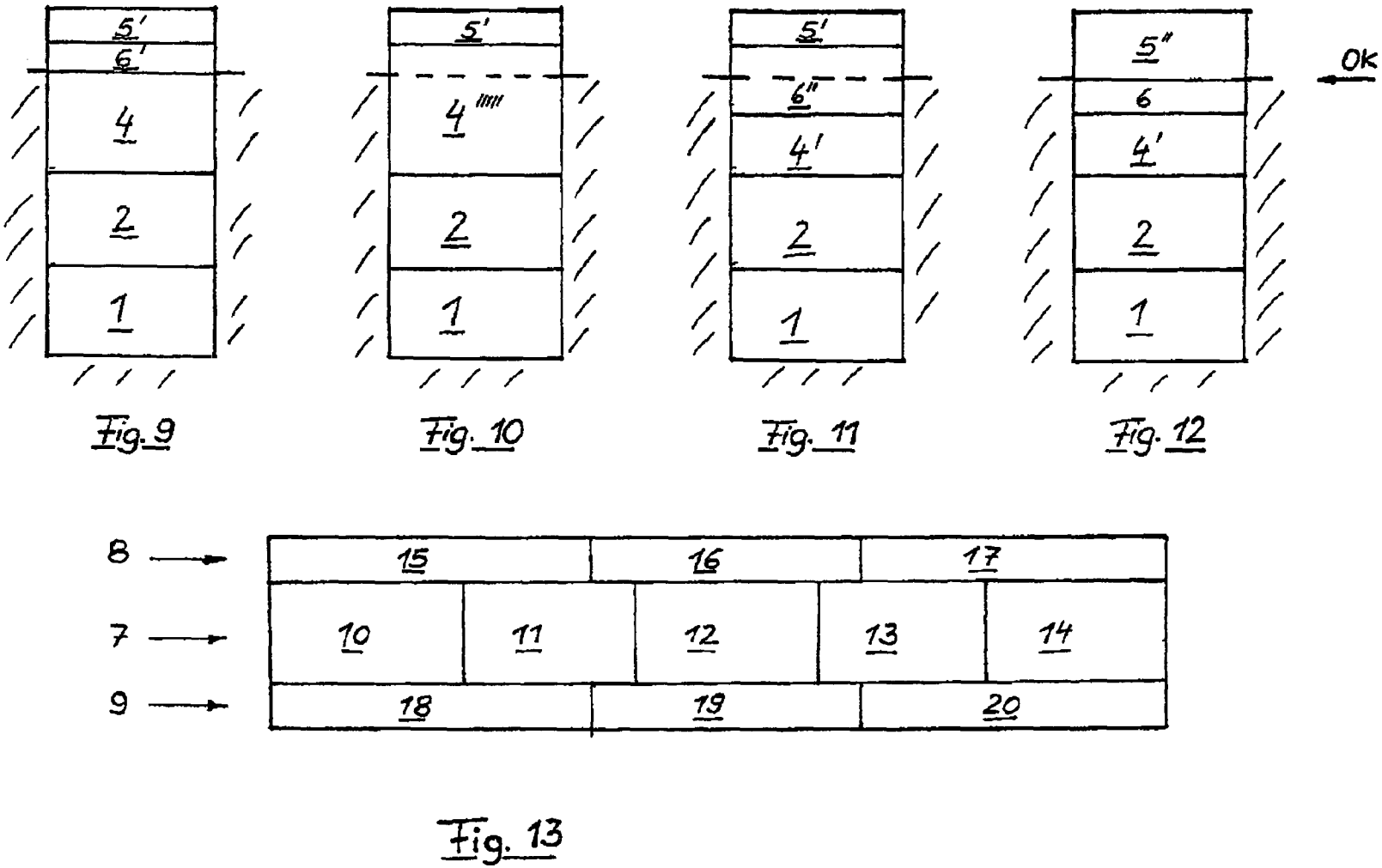
FIG. 9 shows, in section, the structure of a renewed way according to a eighth embodiment.
FIG. 10 shows, in section, the structure of a renewed way according to a ninth embodiment.
FIG. 11 shows, in section, the structure of a renewed way according to a tenth embodiment.
FIG. 12 shows, in section, the structure of a renewed way according to a eleventh embodiment; and, FIG. 13 is a plan view of the way showing individual work subzones.

The roadway or runway in need of renewal has a conventional structure as shown in FIG. 1 which comprises a frost-protective layer 1, a base layer or base course 2 and a concrete pavement or cover layer 3. After a longer time span during which the way has been subjected to load, the concrete cover layer 3 of the way shows distressed spots on its surface, unevenness and fissures which are indicated schematically in FIG. 1.

Renewed ways can be of different embodiments which are described hereinafter.

Accordingly, FIG. 2 shows a first embodiment of a renewed roadway or runway having a frost-protective layer 1 and a base layer 2 which are unchanged compared to the frost-protective layer 1 and the base layer 2 of the renewal-needing way of FIG. 1 and are therefore configured in the same way. As a difference to the renewal-needing way, the way of FIG. 2 has an asphalt base layer 4 which comes up to the upper face OK of the renewal-needing way of FIG. 1. On top of this asphalt base layer 4 and therefore above the upper face OK, an asphalt cover layer 5 is shown which has, inter alia, a finer grain compared to the asphalt base layer 4.

In a second embodiment of a renewed roadway or runway of FIG. 3, the way has a same frost-protective layer 1, a same base layer 2, an asphalt base layer 4' and a same asphalt cover layer 5 in correspondence to FIG. 2. The asphalt base layer 4' has a reduced thickness compared to the asphalt base layer 4 of FIG. 2. An asphalt binder layer 6 is disposed between this asphalt base layer 4' and the asphalt cover layer 5. The asphalt base layer 4' and the asphalt binder layer 6 are so designed that the asphalt binder layer 6 comes up to the upper face OK of the way (roadway or runway).

A third embodiment of a renewed or renovated roadway or runway of FIG. 4 is configured in the same way as the first embodiment of FIG. 2, but the asphalt base layer 4" is configured with a greater thickness and the base layer 2' is configured with a reduced thickness. To better illustrate, the partition interface between the base layer 2 and the asphalt base layer 4, which can be seen in FIG. 2, is made recognizable here in FIG. 4 by a broken line.

A fourth embodiment of FIG. 5 shows the same configuration as in the second embodiment of FIG. 3, but has a somewhat thinner base layer 2' and a somewhat thicker asphalt base layer 41" is used. The asphalt binder layer 6 again comes up to the upper face OK of the old way (the roadway or runway before renewal).

A fifth embodiment of FIG. 6 has again the frost-protective layer 1 and an asphalt base layer 4'" which extends up to the upper face OK of the old way. An asphalt cover layer 5 is again disposed on top of this upper face OK.

A sixth embodiment of FIG. 7 is shown again in correspondence to the embodiment of FIG. 6. A somewhat thinner asphalt base layer 4"" is provided and an asphalt binder layer 6 is arranged between the asphalt base layer 4"" and the asphalt cover layer 5. The asphalt binder layer 6 again comes up to the upper face OK of the old way.

A seventh embodiment of FIG. 8 is comprised of one of the six embodiments of FIGS. 2 to 7 described above. The asphalt cover layer 5' ends flush with the upper face OK of the way.

An eighth embodiment of FIG. 9 again comprises a frost-protective layer 1, the base layer 2, the asphalt base layer 4, an asphalt binder layer 6' as well as an asphalt cover layer 5'. The asphalt base layer 4 comes up to be flush with the upper face OK and the asphalt binder layer 6' is arranged above the upper face OK.

A ninth embodiment of FIG. 10 has the frost-protective layer 1, the base layer 2, an asphalt base layer 4""" as well as the asphalt cover layer 5'. The asphalt base layer 4""" is configured to be thicker compared to the asphalt base layer 4 and extends to above the upper face OK.

A tenth embodiment of FIG. 11 comprises the frost-protective layer 1, the base layer 2, the asphalt base layer 4', an asphalt binder layer 6" and the asphalt cover layer 5'. The asphalt binder layer 6" is thicker than the asphalt binder layer 6 or 6' so that the asphalt binder layer 6" extends from a region below the upper face OK up into a region above the upper face OK.

In an eleventh embodiment shown in FIG. 12, the frost-protective layer 1, the base layer 2, the asphalt base layer 4' and the asphalt binder layer 6 are provided and the asphalt binder layer 6 is flush with the upper face OK of the roadway or runway. Also, an asphalt cover layer 5" is provided above the upper face OK and is thicker than the asphalt cover layer 5 or 5' used up to now.

The way of FIG. 13 is subdivided into a primary lane 7, a secondary lane 8 on one side of the primary lane 7 and a secondary lane 9 on the other side of the primary lane 7. The primary lane 7 is arranged in the region of the largest and most often occurring load which, for example, lies in the middle of the runway in a take-off and landing runway for aircraft. The two secondary lanes 8 and 9 are subjected only to reduced loading. The width of the primary lane 7 is oriented to the type of aircraft and to the overall width of the runway. The runway is so designed that at least the landing gear width is considered as well as sufficient safety zones on both sides. Accordingly, the width of the two secondary lanes (8, 9) results from the total width of the take-off and landing runway and the width of the primary lane 7. The primary lane 7 and each secondary lane (8, 9) are subdivided into work subzones 10 to 20 which are areas of the same size. Because of the different widths of the primary lane 7 and the two secondary lanes (8, 9), the work subzones 15 to 20 of the two secondary lanes (8, 9) extend further in the direction of the runway than the work subzones 10 to 14 of the primary lane 7.

A renovation or renewal of a worn runway therefore begins first with the subdivision of the runway into primary and secondary lanes (7, 8, 9) and into corresponding work subzones 10 to 20. Here, the area size of the work subzones 10 to 20 is dependent upon the time duration during which the runway can be closed and in dependence upon the capacity of the building contractor conducting the work for the time duration of the closure. For a take-off and landing runway, the closure time is usually shifted to nighttime because, as a rule, there is anyway a prohibition of nighttime flights or a limiting of flight operations.

First, the work subzones 10 to 14 of the primary lane 7 are processed in that for each out-of-service time period, a work subzone 10 to 14 is finished from demolition to completion. The completed work subzone 10 to 14 is at the same elevation as the next adjacent work subzone 10 to 14 which is not yet processed or worked upon so that the flight operations can be conducted without restrictions between the out-of-service times. After completion of the primary lane 7, the secondary lanes (8, 9) are processed in the same way as the primary lane 7. In this connection, the drainage units arranged in these subzones are, as a rule, also exchanged.

It is a precondition for the renewal of an old roadway or runway that the already present frost-protective layer 1 and the base course or base layer 2 had been properly constructed at the time of original construction and are not an obstacle to further use. A corresponding evaluation of existing drawings and additional laboratory investigations provide adequate information. For a defective quality of the base layer 2, a partial or complete exchange takes place as shown in FIGS. 2 to 12.

The renewal of a work subzone 10 to 20 begins with the crushing of the concrete surface layer 3 of the old way. Thereafter, the crushed concrete surface layer 3 is taken up and transported away. Thereafter, depending upon the quality of the base layer 2, measures are taken to increase the load bearing capacity of the base layer 2. Such measures can, for example, be a recompaction of the base layer or the production of a hydraulically bonded base layer from the available base layer material.

Thereafter, the asphalt base layer (4, 4", 4'") is brought in up to the elevation of the upper face OK and, for this, asphalt finishers are put to work in the conventional manner. Thereafter, the load bearing capacity of the introduced asphalt base layer (4, 4", 4''') is finally measured and a determination is made as to the further construction of the remaining layers which are to be introduced.

Accordingly, the final measurement can indicate that the upper portion of the new asphalt base layer (4', 4", 4'''') of FIGS. 3, 5, 7, 9, 11 and 12 is to be configured as an asphalt binder layer 6 which is realized without difficulty. The asphalt binder layer 6 can be arranged below or above the upper face OK. According to FIG. 11, it is, however, also possible to configure the asphalt binder layer to be thicker and to arrange the same so that, relative to the upper face OK of the old way, a portion of the asphalt binder layer lies therebelow and a portion thereof lies thereabove.

In the cases wherein the asphalt base layer (4, 4", 4''') or the asphalt binder layer is raised to the elevation of the upper face OK of the old way, there results an elevation-balanced joining to the old surface layer or to the upper face of the already renewed work subzones 10 to 20 of the way so that an unrestricted use of the way is possible for the time when there is no construction work being performed. In those cases where the build up of the new way goes beyond the level of the upper face OK of the old way because of bearing capacity reasons, flat ramps are applied to ensure the running flight operations at the transition locations between a new work subzone 10 to 20 and the neighboring old runway surface. This is again compensated in later processing.

For an in-between use of the already finished work subzones 10 to 20, it can happen that slight track grooves form in the new asphalt base layer 4 or the asphalt binder layer 6 which is attributed to the high temperature of the asphalt during the beginning of usage. These track grooves are then milled away and thereby compensated after a corresponding cooling of the asphalt, for example, during work on the next one of the work subzones 10 to 20.

The final measurement shows also the thickness and the position of the cover layers (5, 5', 5"). The position of the asphalt cover layer (5, 5") is basically above the upper face OK of the old way.

The final measurement can also show that the asphalt binder layer 6 is not needed and/or the already introduced asphalt base layer (4, 4', 4", 4''', 4'''', 4''''') can again be milled off and the asphalt cover layer 51 can be introduced below the upper face OK. This is shown, for example, in FIG. 8.

This asphalt cover layer (5, 5', 5") is then applied, in the determined thickness and in one operation, above or below over all work subzones 10 to 14 of the primary lane 7, over all work subzones 15 to 17 of the one secondary lane 8 as well as over all work subzones 18 to 20 of the other secondary lane 9. In this way, the individual lanes (7, 8, 9) are each completed in one operation which does not preclude that the finishing asphalt cover layer (5, 5', 5") can be applied over a lesser number of work subzones 10 to 20 of the individual lanes (7, 8, 9) or even according to another area pattern.

It is understood that the foregoing description is that of the preferred embodiments of the invention and that various changes and modifications may be made thereto without departing from the spirit and scope of the invention as defined in the appended claims.

LIST OF REFERENCE NUMERALS

1 Frost-protective layer
2 Base layer or base course
3 Concrete cover layer
4 Asphalt base layer
5 Asphalt cover layer
6 Asphalt binder layer
7 Primary lane
8 Secondary lane
9 Secondary lane
10 Work subzone of the primary lane
11 Work subzone of the primary lane
12 Work subzone of the primary lane
13 Work subzone of the primary lane
14 Work subzone of the primary lane
15 Work subzone of one secondary lane
16 Work subzone of one secondary lane
17 Work subzone of one secondary lane
18 Work subzone of the other secondary lane
19 Work subzone of the other secondary lane
20 Work subzone of the other secondary lane

What is claimed is:

1. A method for renewing a roadway for motor vehicles and a runway for aircraft, the way having an upper face (OK) before the renewal thereof and including a frost-protective layer, a base coarse layer and a cover layer, the method comprising the steps of:

demolishing and renewing one or more of said layer(s) no longer needed while leaving at least said frost-protective-layer in the earth;

applying at least one asphalt base layer onto said frost-protective layer and bringing said asphalt base layer up to the level of said upper face (OK);

measuring a load bearing capacity of said asphalt base layer in order to make a final determination of the thickness of an asphalt cover layer; and, applying said asphalt cover layer onto said at least one asphalt base layer to a level above said upper face (OK) and to have a thickness corresponding to said thickness determined from said measurement of load bearing capacity.

2. A roadway for motor vehicles and a runway for aircraft produced in accordance with the method of claim 1, the way having an upper face OK before a renewal of said way, is carried out, the way having been renewed and now comprising:

a frost-protective layer;

a base course disposed atop said frost-protective layer;

said frost-protective layer and said base course having been present before and after said way was renewed;

an asphalt cover layer disposed above said upper face OK;

an asphalt base layer interposed between said base course and said asphalt cover layer; and, said asphalt cover layer and said asphalt base layer being present and part of said way after the renewal thereof.

3. The way of claim 2, further comprising an asphalt binder layer interposed between said asphalt base layer and said asphalt cover layer.

4. The way of claim 3, wherein said asphalt cover layer is below or above said upper face OK or extends above said upper face OK.

5. The method of claim 1, wherein said base coarse layer is also left in the earth.

6. The method of claim 1, wherein an asphalt binder layer is applied so as to be sandwiched between said asphalt base layer and said asphalt cover layer; and, said asphalt cover layer is applied so as to: (a) come up to the level of said upper face (OK); (b) start at the level of said upper face (OK); or, (c) start at a level above said upper face (OK).

7. The method of claim 6, comprising the further step of compensating elevation differences between mutually adjacent renewed and nonrenewed subzones with flat ramps to accommodate traffic during times renewal work is not taking place.

8. The method of claim 1, comprising the further step of processing the material of said base coarse layer to a hydraulically bonded base coarse layer to improve the load bearing capacity thereof.

9. A roadway for motor vehicles and a runway for aircraft, the way having an upper face OK before a renewal of said way is carried out, the way having been renewed and now comprising:

a frost-protective layer;

a base course disposed atop said frost-protective layer;

said frost-protective layer and said base course having been present before and after said way was renewed;

an asphalt cover layer disposed above said upper face OK;

an asphalt base layer interposed between said base course and said asphalt cover layer;

said asphalt base layer having a predetermined load bearing capacity measured after said asphalt base layer is applied to said base course to permit a determination of the thickness of said asphalt cover layer; and, said asphalt cover layer and said asphalt base layer being present and part of said way after the renewal thereof with said asphalt cover layer having said thickness corresponding to said load bearing capacity.

10. The way of claim 9, further comprising an asphalt binder layer interposed between said asphalt base layer and said asphalt cover layer.

11. The way of claim 10, wherein said asphalt cover layer is below or above said upper face OK or extends above said upper face OK.

* * * * *

UNITED STATES PATENT AND TRADEMARK OFFICE

CERTIFICATE OF CORRECTION

PATENT NO. : 8,021,076 B2
APPLICATION NO. : 12/379811
DATED : September 20, 2011
INVENTOR(S) : Friedemann Hoppe It is certified that error appears in the above-identified patent and that said Letters Patent is hereby corrected as shown below:

On title page:
Under (73) Assignee: delete "Ilackmann" and substitute -- Hackmann -- therefor.

In column 5:
Line 34: delete "41"" and substitute -- 4" -- therefor.

In column 7:
Line 40: delete "51" and substitute -- 5' -- therefor.

In column 8:
Line 37: delete "way," and substitute -- way -- therefor.

Signed and Sealed this
Third Day of April, 2012

David J. Kappos

David J. Kappos
*Director of the United States Patent and Trademark Office*